United States Patent [19]

Ashford et al.

[11] Patent Number: 4,627,496

[45] Date of Patent: Dec. 9, 1986

[54] SQUEEZE CEMENT METHOD USING COILED TUBING

[75] Inventors: James D. Ashford; Terry W. Harrison; James K. Eastlack, all of Anchorage; Curtis G. Blount, Wasilla; Gary D. Herring, Anchorage, all of Ak.; David R. Underdown, Plano, Tex.

[73] Assignee: Atlantic Richfield Company, Los Angeles, Calif.

[21] Appl. No.: 760,259

[22] Filed: Jul. 29, 1985

[51] Int. Cl.[4] ..... E21B 31/13

[52] U.S. Cl. ..... 166/292; 166/291; 166/293; 166/297

[58] Field of Search ..... 166/253, 277, 281, 285, 166/291, 292, 293, 297

[56] References Cited

U.S. PATENT DOCUMENTS

| | | | |
|---|---|---|---|
| 2,842,205 | 7/1958 | Allen et al. | 166/285 |
| 4,445,575 | 5/1984 | Perkins | 166/285 X |
| 4,531,583 | 7/1985 | Revett | 166/253 |

*Primary Examiner*—Stephen J. Novosad

*Assistant Examiner*—Thomas J. Odar

*Attorney, Agent, or Firm*—Drude Faulconer

[57] ABSTRACT

A squeeze cementing method wherein the well tubing does not have to be pulled from the well so no workover rig is needed; a smaller volume of squeeze cement is required; the pressures involved in the squeeze operation can be precisely controlled with no risk of fracturing the formation; and there is no need for any drilling operations to remove hardened cement remaining in the well casing. More specifically, the present invention provides a squeeze cement operation that is carried out with a coiled tubing. The wellbore is isolated adjacent the perforations by flowing a packing fluid having a density greater than the cement through the coiled tubing to fill the lower part of the wellbore. An incompressible loading fluid is then flowed onto the packing liquid and this is followed by pumping the squeeze cement down the coiled tubing. After the cement is placed, a contaminating liquid is flowed down the coiled tubing to mix with the cement left in the casing and prevent it from setting. The contaminated cement and packing liquids are then removed from the casing which is then reperforated and returned to production.

21 Claims, 3 Drawing Figures

28
26a
38
39
29
30
10
17
20
19a
18
11
40
16
13
26
19
24
39
23
36
22a
14
31
14
33
21
15
27
32
14a
21
35
22b

FORMATION FRACTURE PRESSURE
6000
BOTTOM HOLE PRESSURE (psia)
4000
2000
0
1
2
3
4
5
a
b
c
d
e
TIME (HOURS)

13
19
24
26
23
36
14
31
14
33
27
32
21
15
21
25
35
22

SQUEEZE CEMENT METHOD USING COILED TUBING

TECHNICAL FIELD

The present invention relates to a "squeeze cement" operation for a land based or offshore well and more particularly relates to a method for filling and plugging channels in the cement behind the casing or perforations in a well with squeeze cement that is carried out through a coiled tubing.

BACKGROUND ART

In completing most petroleum-producing wells, it is common to provide casing throughout the wellbore and then secure the casing in place by placing cement between the casing and wellbore to fill the space therebetween. As known, the cement oftens develops voids or channels therein that, if in certain areas of the well, can lead to substantial problems in the operation the well. For example, it is not uncommon for channels to occur in the cement adjacent the perforations which are formed through the casing adjacent a producing formation to provide access for productions fluids into the casing. If such channels extend downward, water which normally underlies a hydrocarbon producing formation or zone will flow up through the channels and through the perforations to be produced with the desired fluids thereby causing high water-to-oil ratios. Since this water has to be separated and disposed of at the surface, the economics of the well can be substantially adversely affected. If such channels extend upward, gas which overlies the producing zone flows downward through the channels thereby causing high gas-to-oil ratios.

When increased water or gas production is detected and it is determined that it is being caused by channeling within the cement, it is common in the art to perform a "squeeze cement" operation to plug these channels to thereby block flow of gas or water to the production zone from the overlying or underlying zones. A typical hereto known operation for carrying out such an operation involves pulling the production tubing and any related downhole equipment from the well bore, packing off the effected interval, and pumping cement under pressure down the borehole and into the channels through the perforations. The cement is allowed to set and then a drill bit is lowered on a drill string through the casing to drill out the cement plug normally left in the casing. The casing is then re-perforated and the tubing is replaced or vice versa to complete the operation.

The above-described operation requires a work-over rig to pull and replace the tubing and to drill the cement out of the casing once it has set. While necessary, this is both expensive and time-consuming. The "tree" at the wellhead has to be "nippled down" or the well has to be disconnected from the production facilities in order for the production tubing to be pulled. The above procedure then has to be reversed after the squeeze operation has been carried out before production can be resumed thereby extending the downtime during which time the profits for production are lost.

Also, when using a rig, mud or a "kill pill" is used to maintain pressure control on high pressure wells. This mud or "kill pill" normally plugs the channels and has to be cleaned out in order to get a good squeeze job. The cleaning of the channels is extremely difficult if is can be done at all. Further, during the drilling of the cement left in the casing, the casing may be damaged by the drill bit and the vibrations in the casing caused by the drilling may loosen or redamage the cement behind the casing.

DISCLSOURE OF THE INVENTION

The present invention provides a squeeze cementing method which provides several advantages over previous known methods. In the present invention, the well tubing does not have to be pulled from the well so no workover rig is needed. Also, a smaller volume of squeeze cement is required which can be more accurately placed in the wellbore. Further, the pressures involved in the squeeze operation can be precisely controlled with no risk of fracturing the formation. Still further, neither mud nor a "kill pill" is required since the wellbore is loaded only with clean, filtered fluid which allows a channel to take fluid easily thus making it unnecessary to breakdown (hence, seriously damage) the formation prior to the squeeze operation. Also, there is no need for any drilling operations to remove harden cement from the well casing after the cementing operation thereby eliminating (a) the possible damage to the casing sometimes caused by a drill bit and (b) any decrease in the casing cement integrity sometimes caused by vibrations during drilling.

The present invention also adds operational flexiblity in that the well remains connected to its production facility thereby allowing flowback to clean casing perforations and flow testing the squeeze. Also, since the production tubing does not have to be pulled and then replaced nor the well disconnected from its production facility, the well can be returned to production much quicker (e.g. 5 times quicker than with previus squeeze operations).

More specifically, the present invention provides a squeeze cement operation that is carried out with a coiled tubing. In accordance with the present invention, once a change in well performance suggests that an unwanted fluid (i.e. water, gas, or even oil in a gas well) is flowing through channels in the casing cement to the production perforations in the well casing, logs are run to confirm the existence and location of these channels. The coiled tubing is then lowered through the well tubing and the rathole (i.e. wellbore below the casing perforations) is cleaned by circulating production water or the like through the wellbore.

Next, the wellbore is isolated adjacent the perforation by flowing a packing fluid though the coiled tubing to fill the rathole from the bottom of the wellbore to a point just below the lowermost of the perforations. The packing liquid, e.g. heavily-weighted brine, mud, etc., has a density equal to or greater than that of the squeeze cement to be used whereby the packing liquid support the squeeze cement thereon without any substantial mixing of the two.

The wellbore above the packing liquid and the well tubing is then loaded with an incompressible loading liquid, e.g. production water. Flow from the wellbore through the well tubing is closed and the coiled tubing is lowered to the top of the packing fluid. The volume of uncontaminated squeeze cement calculated to be that needed to fill the channels, perforations, and the casing from the level of the packing liquid to a point just above the uppermost perforations is then flowed through the coiled tubing as it is being raised. The loading liquid will flow through the perforations into the formation until the squeeze cement covers the perforations but will then act to force uncontaminated squeeze cement through the perforations to fill the unwanted channels in the casing cement. A sustained increase in the pump pressure over a defined period of time indicates that the channels are filled whereupon from the well tubing is released (the well still being slightly overbalanced) and the coiled tubing is raised to dump any remaining cement into the casing.

The coiled tubing is then raised to the highest possible point cement could be assuming no cement went outside the casing. The coiled tubing is then lowered down through the cement in the casing and into the top layer of the packing liquid. A cement contaminating liquid, e.g. bentonite - borax aqueous mixture, is flowed through the coiled tubing as it is lowered to mix and contaminate the squeeze cement into the casing. The pump rate of the contaminating liquid verses the descent rate provides a minimum 50% to 50% or 1 to 1, by volume, mixture of contaminating liquid to cement in the well bore. The contaminating liquid acts to retard the setting time of the cement to prevent it from hardening in the casing.

preferably, the well is then shut in and a pressure is maintained on the cement which is slightly in excess of the well's normal shut in pressure until the uncontaminated cement in the channels has harden. The coiled tubing is then lowered to the top of the contaminated cement and the packing liquid and the contaminated squeeze cement is removed therethrough by pumping down the production tubing and taking returns out of coiled tubing. The casing is then jetted with the coiled tubing with production water or the like and reperforated to complete the squeeze cement method of the present invention. In some instances, however, the contaminated cement and the packing liquid may be removed immediatley after contamination without a shut-in-period.

BRIEF DESCRIPTION OF THE DRAWINGS

The actual construction, operation, and apparent advantages of the present invention will be better understood by referring to the drawings in which like numerals identify like parts and in which.

BEST MODE FOR CARRYING OUT THE INVENTION

Figures 1, 2, 3:
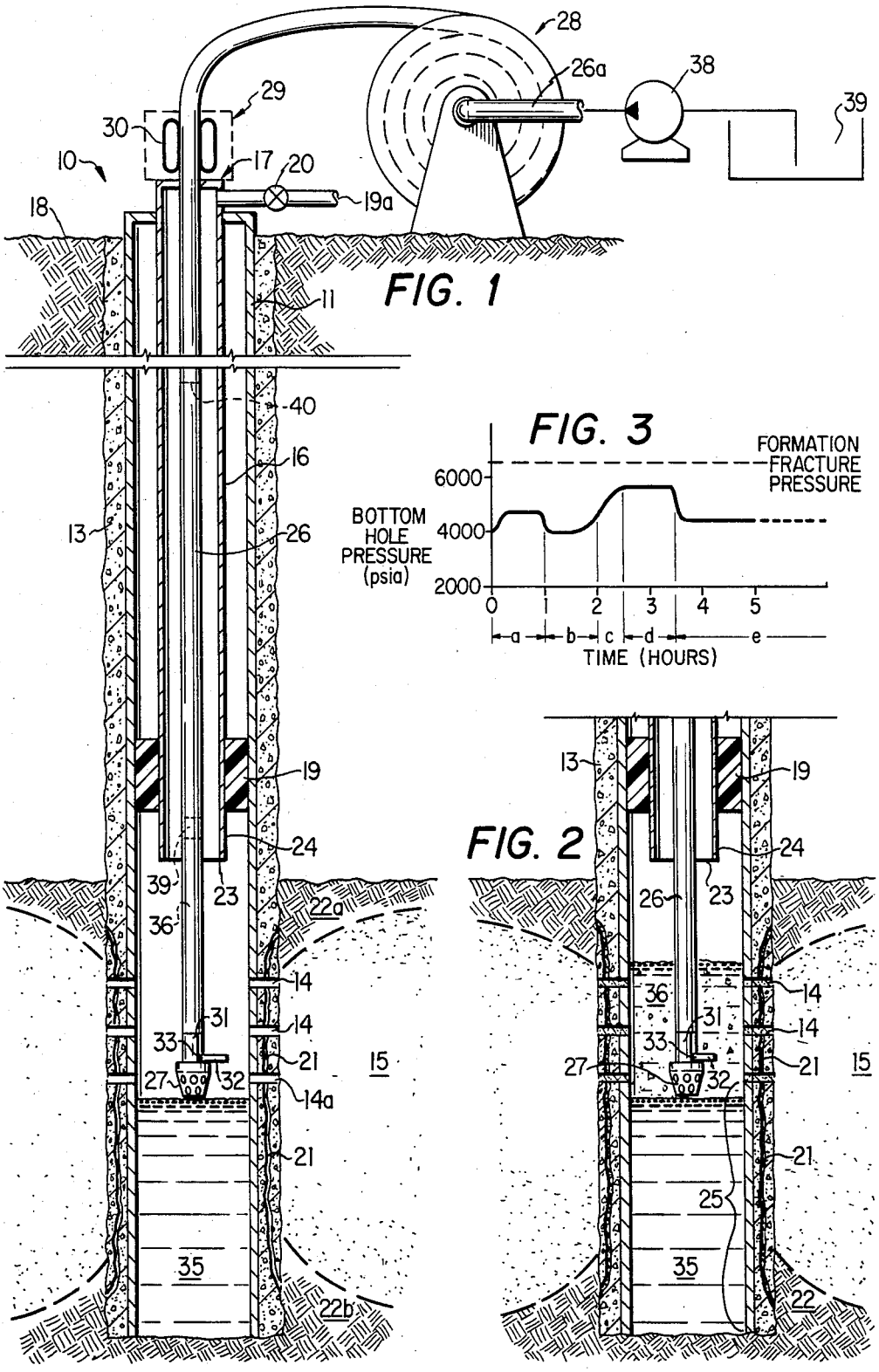
FIG. 1 is a sectional view of well showing an early step of the squeeze cementing method of the present invention.
FIG. 2 is a sectional view of the lower end of the well of FIG. 1 showing a further step of the present squeeze cementing method.
FIG. 3 is a graphic representation of the typical bottom hole well pressures involved in the present invention.

Referring more particularly to the drawings, FIG. 1 discloses a well 10 having a casing 11 extended throughout the depth of the wellbore thereof. As will be understood in the art, casing 11 is cemented in the wellbore by placing casing cement 12 between casing 11 and the wellbore. Casing 11 is perforated to form perforations 14 adjacent producing formation or zone 15 to provide flow passages for fluids from formation 15 into casing 11. A production tubing 16 having a tubing head 17 extends down within casing 11 from the surface 18 and has a packer 19 thereon to isolate the production interval of the wellbore as is known in the art. An outlet or return pipe 19 having a valve 20 therein is connected to tubing head 17 for a purpose discussed below.

As illustrated in FIG. 1, for whatever reason, channels 21 have formed in casing cement 13 which communicate with perforations 14 and extend upward or downward into contact with a gas zone **22*a* or water zone 22*b* or other unwanted fluid which lies over or under production zone 15. As used herein, "channel" refers to any flowpath, fracture, etc., in cement 13 which is capable of fluid flow. As known in the art, as fluids (i.e. hydrocarbons) are produced from production zone 15, gas from zone 22*a* will flow downward or water from water zone 22*b* will flow upward under pressure to replace same. It can be seen that as gas or water reaches the upper or lower ends of channels 21, it will continue to flow therethrough and out perforations 14** to mix with production fluids to be produced therewith to the surface.

In accordance with the present invention, once a substantial change in the performance of a well is detected (e.g. increased gas or water cut from the produced fluids), a series of diagnostic logs are run. For example, a known and commercially-available cement evaluation log is run to determine if channels 21 do exit and the location or depth of same within the wellbore. Also, a commercially-available temperature log is run to determine the downhole temperature in the region of channels 21. As these logs are being run, the depth of lower end 23 of tubing tail 24 (i.e. that portion of tubing 16 which extends below packer 19) is identified with a tubing tail locator or equivalent on the logging line (not shown). This measured depth can be used later to confirm or adjust the depth of the tubing tail which is measured during the squeeze cement operation of the present invention as will be discussed below.

Once it has been estabished that channels 21 do exist, the rathole 25 (i.e. portion of the wellbore that lies below perforations 14) is preferably cleaned by lowering coiled tubing 26 down through tubing head 17 and tubing 16 and jetting production water therethrough out nozzle 27. To minimize the risk of pumping fluids from rathole 25 into the formation 15 through perforations 14, well 10 is preferably flowed through tubing 16 while the jetting operation is carried out. Rathole 25 may also be cleaned by pumping down production tubing 16 at such a rate as to increase the bottom hole pressure whereby the rathole fluids are reversed out through coiled tubing 26.

Coiled tubing 26 is a continuous length (e.g. 16,000 feet) made up of steel tubing (e.g. 1 to 1½" diameter) which is coiled onto a reel 28 and has its inner end **26*a* connected to pump 38 which, in turn, draws liquids from source 39. Coiled tubing 26 is fed into and out of well 10 through an injector head 29 which has driven track means 30 for gripping and moving tubing 26. Tubing 26 will normally be fed by injection head 29** through a standard blow-out preventor and/or stuffing box (neither shown) to allow pressure to be maintained in the wellbore as will be understood in the art. Coiled tubing units such as described are known and are commercially-available (e.g. Arctic Coiled Tubing, Inc., Anchorage, Ak.).

A tubing tail locator 31 is attached to the lower end of coiled tubing 26, just above nozzle 27. As shown, locator 31 is comprised of a pin 32 that is pivoted at 33 and is normally held in a vertical position (not shown) as locator 31 is lowered through tubing 16. Pin 32 falls to a horizontal position (FIG. 1) as locator 31 moves out the lower end of tubing 16. When coiled tubing 26 is moved upward, horizontal pin 32 engages lower end 23 which temporarily stops the movement of coiled tubing 26. This increased resistance is noted at the surface and the length of coiled tubing 26 between the bottom 23 of tubing tail and the surface is noted. Power is increased to injector head 29 so the upward pull will shear pin 32 thereby allowing coiled tubing 26 to be removed through tubing 16. Of course, other known locators or equivalents cna be used without departing from the present invention.

After rathole 25 is cleaned, coiled tubing 26 is again lowered to the bottom of rathole 25 and is pulled upward as a packing liquid 35 is flowed into the rathole 25 through nozzle 27. Packing liquid 35 is comprised preferably of a heavily-weight brine or a heavy drill mud; both of which will be described and discussed in more detail below. The density (i.e. weight per unit volume) of liquid 35 must be equal to or heavier than the density of the cement to be used in the squeeze operation.

Well records and previously-run logs such as tubing tallies, electric line, and open hole caliper runs which are available for the well 10 being treated are used in correlating the various depths within the wellbore and in calculating the required volumes of the materials (e.g. packing liquid, cement, etc.) to be used. The volume of packing fluid 35 is calculated to fill the rathole 25 to a point just below the lower most of perforations 14*a* so that packing liquid 35 will not flow into formation 15. This is not as critical where liquid 35 is a clear brine as it is when the liquid is formation-damaging mud as will become evident from the following discussions. Perforations 14*a* may be existing perforations or if the logs establish that the existing perforations are not in good communication with channels 21, additional perforations (i.e. squeeze perfs) can be provided at a position as determined by the cement evaluation log which is run earlier.

With packing fluid 35 is in place, the wellbore above packing liquid 35 and tubing 16 is loaded with an incompressible loading liquid (e.g. production water) through coiled tubing 26 and valve 20 in return line 19 is closed. Coiled tubing 26 is then lowered to the top of packing liquid 35 and squeeze cement 36 is flowed down coiled tubing 26 out nozzle 27. Coiled tubing is raised at a rate to maintain a small amount (e.g. 0.5 to 3 barrels) of cement above nozzle 27 as the calculated volume of squeeze cement is flowed into the wellbore.

As the calculated volume of cement 36 is pumped into coiled tubing 26 by pump 38 from a source 37, it is followed by a spacer liquid 39 (e.g. water) and a cement contaminating liquid 40 (FIG. 1). The volume of squeeze cement 36 should equal the amount of cement calculated to fill channels 21, perforations 14, and the wellbore to a level above the uppermost perforations 14. During the pumping of cement 36, valve 20 in return line 19 remains closed so that loading liquid can not flow out of tubing 16. Loading fluid will flow through the perforations and into formation 15 until cement 36 covers perforations 14 and then will act as an incompressible barrier to force uncontaminated squeeze cement 36 through perforations 14, 14*a* to fill channels 21.

The pumping operation is continued with no returns until a sustained "bump" in pump pressure is noted. This sustained pressure indicates that cement has ceased to flow through perforations 14. To prevent the fracturing of formation 15, valve 20 is then opened and loading liquid is allowed to flow from the wellbore tubing 16. The pumping is continued as the coiled tubing is raised until all the cent 36 in coiled tubing 26 is dumped into the wellbore (FIG. 2). Coiled tubing 26 is raised to the highest point at which cement could possibly be if no cement was squeezed out of the casing and is then lowered through the unset cement 36 and into the upper layers of packing fluid 35. As coiled tubing is lowered, cement contaminating liquid 40 is pumped out of nozzle 27 under pressure (i.e. differential pressure of 1000 psi) to allow the contaminating liqid to mix with the cement and contaminate same thereby retarding the setting time of the cement and preventing it from hardening. The pump rate of the contaminating liquid verses the descent rate of tubing 26 is such to provide at least a minimum 50% to 50% or 1 to 1 (by volume) of contaminating liqid to cement. Preferably, well 10 is shut in for a prolonged period with a pressure on the contaminated squeeze cement which is slightly in excess of the normal shutin bottomhole pressure so that the formation pressure will not cause reverse flow of the cement in the wellbore. The shutin period is long enough to allow the uncontaminated squeeze cement in channels 21 to firmly set and harden. However, in some cases, the cement in the casing is removed immediately after contamination.

At the end of the shutin period, the contaminated squeeze cement 36 and packing liquid 35 are both reversed-circulated out of the wellbore by pumping water or the like down tubing 16 and taking returns through coiled tubing 26. While reverse circulation is preferred, to minimize the number of tubulars that contact the contaminated cement, the contaminated cement and packing liquid can also be jetted out with fluids such as gelled water and nitrogen. A cement evaluation log or other log (e.g. pump-in temperature log) is then run to confirm the effectiveness of the squeeze cement operation after which the casing 13 is re-perforated to complete the operation.

Referring now to FIG. 3, a graphic representation of typical bottom hole pressure verses the times at which such pressures are normally encounted during the present squeeze cement operations is shown. During time segment a (e.g. 1 hour) the welbore is loaded with incompressible loading fluid (e.g. production water). High pump rate will raise the bottom hole static pressure slightly. Production tubing 16 is then shut in with no returns allowed. During time segment b, cement 36 is being pumped down coiled tubing 26. Half of time b (e.g. 30 minutes) is required for the cement to reach bottom and the other half of b (e.g. 30 minutes) is the time required for squeeze pressure to begin to rise as the cement begins to fill the channels.

During time segment c, the channels are filling and the cement is dehydrating (i.e. losing water to the formation). At the start of time segment d, returns are begun to be taken at approximately 1,500 psi above the original bottom hole pressure. This increased pressure is held for approximately 40 minutes. The pressure is dropped at the beginning of time segment e and the contaminating liquid is pumped down coiled tubing 26. This normally takes approximately 2 hours to complete contamination. Again, it is preferred to leave the well shut in at this elevated pressure for a time (e.g. 6–12 hours) to allow the cement to set in the channels but removal of the contaminated cement and the packing fluid can begin immediately upon contamination in some instances. Now that the overall squeeze cement method has been described, the various liquids used in this method will now discussed in greater detail.

Packing Liquid 35

As stated above, packing liquid 35 is a liquid which has a density (i.e. pounds per gallons) that is equal to or heavier than the density of the cement 36 which is to be used in the squeeze cement operation. The equal to or heavier density of the packing liquid prevents any substantial mixing of the cement with the packing fluid and insures that the cement will be supported on and above the packing fluid.

The packing fluid should (1) have substantially the rheological properties as those of the cement; (2) have good fluid loss; (3) be thixotropic; (4) have good gel strength; and (5) preferably be non-damaging to the formation 15. In view of the last-mentioned of the above, a heavily-weighted brine solution is preferred as packing fluid 35 in the present invention since the brine will do little, if any, damage to formation 15 if the calculated volume of liquid 35 is more than is actually needed whereby rathole 25 is overfilled and some of packing liquid flows through perforations 14 into formation 15.

An example of a composition of a brine solution which is preferred in the present invention is as follows. A salt, e.g. sodium bromide, is added to water to weight the resulting solution to the approximate density desired, e.g. 12.7 pounds per barrel. A viscosifying agent is added to provide good suspension of the salt in solution. The viscosifying agent that is prefered is hydroxyethylcellulose )HEC) since this agent does little, if any, damage to formation 15 if the brine solution is inadvertently flowed into contact therewith. Other viscosifying agents include polysaccarides such as cross-linked guar gum polymer, carboxylmethylcellulose, (CMC), and xanthangums (XC) polymers.

The viscosifying agent is cross-linked by adding a cross-linking compound, e.g. zirconium oxychloride (ZOC) to the brine solution. Also, a water softening agent, e.g. ethylenediamenetetraacetic acid (EDTA) is added to soften the water and to completely chelate the cross-link agent.

The brine solution prepared as set forth above has rheological properties similar to those of the cement to be used and will have a density equal to or greater than the squeeze cement (e.g. 12.5 pounds per barrel). The solution is thixotropic in that it will gel upon setting to provide a good gel strength for supporting the cement but will breakdown into a liquid upon agitation so taht it can be pumped from the wellbore after the squeeze cement operation is completed.

As mentioned above, a heavily-weighted mud having a density equal to or heavier than the cement can also be used as packing liquid 35. To formulate a mud having the desired density and properties is well within the drilling mud art. In using a mud, extra care should be taken to prevent overfilling rathole 25 so that the mud will not flow through perforations 14 to contaminate and damage formation 15. Also, the top layer of the mud, once it is in place in the rathole, should be checked to make sure that the density of the mud in this upper layer is not lighter than required due to possible setting. This can be done by running a commercially-available gradiomanometer or fluid density log. If too much mud is in the wellbore or if the upper layer of mud is too light, the unwanted mud can be removed by reverse circulation using coiled tubing 26. It is also pointed out here, that if the wellbore does not have a rathole of any significanct length, the packing liquid step can be dispensed with and the squeeze cement can be placed directly onto the bottom of the wellbore.

Cement 36

The key well parameters which affect the selection of a cement blend are the bottomhole circulating temperature, (BHCT), the bottomhole static temperature, the formation fracture pressure, and the bottomhole static pressure. Once the squeeze cement is squeezed into the perforations 14, circulation of fluid in this area halts. Thus, the cement will experience a gradual rise in temperature to the static bottomhole temperature. The fluid (water) loss from a cement slurry increases significantly with increased temperature. It is recommended that the water loss for a cement blend be based on the bottomhole static temperature (the highest temperature the cement should experience).

The thickening time, which is the length of time a cement slurry remains fluid enough to be pumped with the available equipment, is also affected by temperature. However, in this case, the concern is to be able to pump and contaminate the slurry as its temperature rises from the mix temperature to the bottomhole static temperature. Thus, one of the key temperatures used in the thickening time schedule (discussed below) is the average of the bottomhole static and circulating temperatures. The maximum squeeze pressure is always less than the formation fracture pressure.

Using the above well parameters, the cement blend should be designed to satisfy the following general requirements: (a) it must be pumpable based on the rheological properties of the blend and the available equipment; (b) the thickening time must be long enough to ensure that the cement does not harden in the surface piping, coiled tubing or wellbore prior to contamination; (c) when squeezed under pressure, sufficient filtercake must be deposited on the formation and within the channel to seal off the flow of unwanted fluids, yet not be excessive causing node formation within the wellbore; (d) after squeeze pressure is released, the viscosity of the cement in the wellbore must be low enough to allow homogeneous contimination (accomplished by pumping in contaminant while running through the cement with the coiled tubing); (e) the cement/contaminant slurry must have a thickening time that is greater than the time needed to remove the contaminated cement; and (f) the cement/contaminant slurry must be designed so that solids do not settle out prior to removal from the wellbore.

Cement Contaminating Liquid 40

The cement contamination liquid is a mixture which is capable of retarding or extending the thickening or setting time of the cement remaining in the wellbore so that the contaminated cement can be pumped out and removed from the wellbore without drilling. Preferably, the contaminating liquid is a bentonite-borax mixture comprised of approximately 10 to 15 pounds of bentonite per barrel of water and approximately 20 pounds of borax per barrel of water. The volume of this mixture used in the present invention is at least equal to that of the volume of squeeze cement pumped (i.e. at least 1 barrel of contamination liquid for each barrel of cement pumped into the wellbore) or a volume ratio of 1 to 1, although normally more contaminating liquid will be used (e.g. volume ration of 2 to 1).

For use in sub-freezing conditions, (e.g. Arctic), a mixture of up to 50% methanol in water can be substituted for the mix water. This mixture will also have to be at a temperature in excess of 100F. The user should be aware that methanol will slightly retard the thickening of cement. In other words, contaiminant blended with methanol and water will result in sligthly increased thickening times (when mixed with the cement) compared with that blended with water only. This mixture is also flammable.

What is claimed is:

1. A method of squeeze cementing for filling channels in casing cement between a wellbore and a casing therein, said casing and said casing cement having perforations therethrough to establish fluid communication between said wellbore and a formation adjacent said perforations, said perforations also in fluid communication with said channels; said method comprising:
   isolating said wellbore adjacent said perforations:
   flowing squeeze cement down said wellbore, through said perforations, and into said channels;
   flowing a cement contaminating liquid down said wellbore and mixing said contaminating liquid with said squeeze cement remaining in said wellbore after said channels are filled; and
   removing the contaminated squeeze cement from said wellbore.

2. The method of claim 1 including:
   allowing the squeeze cement in said channels to harden prior to removing said contaminated cement.

3. The method of claim 2 wherein the step of isolating said wellbore comprises:
   filling said wellbore from the bottom thereof to a point below the lowermost of said perforations with a packing liquid; said packing liquid having a density equal to or greater than the density of said squeeze cement.

4. The method of claim 2 wherein said packing fluid comprises a heavily-weighted brine solution.

5. The method of claim 2 wherein said packing fluid comprises a heavily-weighted mud.

6. The method of claim 3 wherein said contaminating liquid is mixed with said squeeze cement in a volume ratio of at least 1 to 1.

7. The method of claim 6 wherein the step of allowing said squeeze cement to harden comprises:
   shutting in the wellbore and maintaining a pressure on the contaminating cement in access to the normal shutin pressure in the wellbore.

8. A method of squeeze cementing a well wherein said well has a casing throughout the wellbore, casing cement between said casing and the wellbore of said well, perforations through said casing and said casing cement to establish fluid communication between the interior of said casing and a formation adjacent said perforations, channels in said casing cement in fluid communication with at least some of said perforations, a well tubing string in said casing extending from the surface to the proximity of said perforations, and a packer means for sealing between said tubing and said casing above said perforations, said method comprising:
   isolating said casing adjacent said perforations;
   lowering a coiled tubing down said well tubing string to a point adjacent said peforations;
   flowing uncontaminated squeeze cement through said coiled tubing and through said perforations into said channels;
   flowing a cement contaminating liquid down said coiled tubing to mix with the squeeze cement remaining in said casing;
   allowing said uncontaminated squeeze cement in said channels to harden; and
   removing said contaminated squeeze cement from said casing through said coiled tubing.

9. The method of claim 8 including:
   allowing the uncontaminated cement in said channels to harden prior to removing said contaminated cement.

10. The method of claim 8 wherein the step of isolating the casing comprises:
   flowing a packing liquid down said coiled tubing to fill the casing from the bottom of the wellbore to a point below the lowermost of said perforations, said packing liquid having a density equal to or greater than the density of said squeeze cement.

11. The method of claim 10 wherein said packing fluid comprises a heavily-weighted brine solution.

12. The method of claim 10 wherein said packing fluid comprises a heavily-weighted mud.

13. The method of claim 10 including:
   flowing an incompressible loading liquid down said coiled tubing prior to the step of flowing said squeeze cement to load said well tubing and said casing between said packer means and said packing liquid with said loading liquid.

14. The method of claim 12 wherein the step of flowing uncontaminated squeeze cement comprises:
   shutting off flow through said well tubing string;
   lowering said coiled tubing to the top of said packing fluid;
   flowing said squeeze cement through said coiled tubing while raising said coiled tubing in said casing;
   opening flow through said well tubing string upon a sustained increase in flow pressure of said squeeze cement; and
   raising said coiled tubing to dump any remaining squeeze cement from said coiled tubing into said casing.

15. The method of claim 14 wherein the step of flowing a cement contaminating liquid comprises:
   lowering said coiled tubing through said squeeze cement remaining in said casing and into said packing liquid; and
   flowing said cement contaminating liquid through said coiled tubing while lowering said coiled tubing through said squeeze cement to allow said cement contaminating liquid to mix with said squeeze cement.

16. The method of claim 15 wherein said cement contaminating liquid is mixed with said squeeze cement in a volume ratio of at least 1 to 1.

17. The method of claim 16 wherein said cement contaminating liquid comprises:
   an aqueous mixture of bentonite and borax.

18. The method of claim 16 wherein the step allowing the uncontaminated squeeze cement to harden comprises:
   shutting off flow through said well tubing while maintaining the pressure on the contaminated squeeze cement remaining in said casing at a value higher than the normal shutin pressure of the well.

19. The method of claim 18 wherein the step of removing the contaminated squeeze cement comprises:
   lowering said coiled tubing through said contaminated squeeze cement, and flowing water down said tubing to force said contaminated squeeze cement upward through said coiled tubing.

20. The method of claim 19 including:

removing said packing liquid from said casing through said coiled tubing.

21. The method of claim 20 including:

re-perforating said casing after said contaminated squeeze cement and said packing liquid is removed.

* * * * *